US006864858B1

(12) United States Patent
Miller et al.

(10) Patent No.: US 6,864,858 B1
(45) Date of Patent: Mar. 8, 2005

(54) RADAR REFLECTING RESCUE DEVICE

(75) Inventors: Gary L. Miller, Rockville, MD (US); Ditmar H. Weiss, Arnold, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 482 days.

(21) Appl. No.: 10/006,757

(22) Filed: Dec. 6, 2001

(51) Int. Cl.[7] ..... H01Q 15/20; H01Q 15/00

(52) U.S. Cl. ..... 343/915; 343/718; 342/8; 342/10

(58) Field of Search ..... 342/5, 6, 7, 8, 342/9, 10; 343/718, 912, 915

(56) References Cited

U.S. PATENT DOCUMENTS

| | | | | | |
|---|---|---|---|---|---|
| 2,463,517 | A | | 3/1949 | Chromak | |
| 2,534,716 | A | | 12/1950 | Hudspeth et al. | |
| 2,888,675 | A | * | 5/1959 | Pratt et al. | 342/8 |
| 3,130,406 | A | | 4/1964 | Jones-Hinton et al. | |
| 3,224,001 | A | | 12/1965 | Radnofsky et al. | |
| 3,276,017 | A | | 9/1966 | Mullin | |
| 3,283,328 | A | | 11/1966 | Wood | |
| 3,618,150 | A | * | 11/1971 | Anselmi | 441/16 |
| 3,671,965 | A | * | 6/1972 | Rabenhorst et al. | 342/8 |
| 4,096,479 | A | | 6/1978 | Van Buskirk | |
| 4,673,934 | A | | 6/1987 | Gentry et al. | |
| 4,768,739 | A | | 9/1988 | Schnee | |
| 4,901,081 | A | | 2/1990 | Bain, Jr. et al. | |
| 5,174,529 | A | | 12/1992 | Jalbert | |
| 5,285,213 | A | | 2/1994 | Tusch | |
| 5,343,202 | A | | 8/1994 | Bell | |
| 5,398,032 | A | | 3/1995 | Tucker et al. | |
| 5,457,472 | A | * | 10/1995 | Bjordal et al. | 343/912 |
| 5,969,660 | A | * | 10/1999 | Veazey | 342/8 |
| 6,101,632 | A | | 8/2000 | Veazey | |
| 6,225,940 | B1 | * | 5/2001 | Ohlsen | 342/5 |
| 6,512,496 | B2 | * | 1/2003 | Alexeff et al. | 343/915 |
| 6,545,606 | B2 | * | 4/2003 | Piri et al. | 340/573.1 |
| 6,570,545 | B1 | * | 5/2003 | Snow et al. | 343/915 |

* cited by examiner

*Primary Examiner*—Tan Ho
(74) *Attorney, Agent, or Firm*—Steven Crabb

(57) ABSTRACT

Radar reflective rescue and safety devices comprise radar permeable coverings around a plurality of reflectors. The radar reflective material may be incorporated into inflatable life vests or foam filled life vests. Additionally, inflatable life rafts with radar reflective cells are able to help personnel lost at sea to be found by radar. The radar reflective cells may also be incorporated into an inflatable cylindrical tube as radar cross-section enhancer separate from other flotation devices. The reflectors are flexible metallic material that forms reflective cavities once the shell is inflated. The reflective cavities may appear as flat surfaces, tilted surfaces, corner reflectors or some combination thereof depending upon the orientation of the cavities to an incident radar wave.

8 Claims, 8 Drawing Sheets

RADAR REFLECTING RESCUE DEVICE

STATEMENT OF GOVERNMENT INTEREST

The invention described herein may be manufactured and used by or for the Government of the United States of America for governmental purposes without payment of any royalties thereon or therefore.

BACKGROUND OF THE INVENTION

This invention relates to radar reflecting flotation devices, and more particularly to life vests and life rafts with reflecting properties to permit radar indication of its location on the surface of large bodies of water from long distances to aid in search and rescue efforts.

Search and rescue missions to locate personnel in large bodies of water are often difficult and the methods used vary in effectiveness. Currently, the best way to search for personnel is to use an Emergency Position Indicating Radiobeacon (EPIRB). However, these units tend to be expensive and only operate for a limited time and are often not available to the person in need of rescue. Visual identification is probably the most common form of search and rescue. Some life vests and life rafts have flashing light beacons to aid in a visual search at night. However, any visual search effort needs good weather and has a very limited range.

Previous U.S. patents have addressed the use of some form of radar cross section enhancer to permit radar to be used to locate objects at sea that by themselves are usually poor radar reflectors and are virtually indistinguishable from the radar return of the surrounding sea. Usually, these have taken the form of either an inflatable or fixed radar reflector that may be added to a life raft or attached to a person in the water. These radar reflectors incorporate corner reflector arrays that provide radar cross-section (RCS) many times greater than the same sized object without corner reflectors. These systems work well when deployed. However, persons in need of rescue often do not have access to these add on devices. Many times the only item a person has is the personal flotation device they are wearing.

SUMMARY OF THE INVENTION

Radar reflective rescue and safety devices comprise radar permeable coverings around a plurality of radar reflectors. In accordance with one aspect of the invention, the radar permeable shell is inflatable, and is worn by an individual as a flotation aid. The reflectors are flexible radar reflective materials that form reflective cavities once the shell is inflated. The reflective cavities may appear as flat surfaces, tilted surfaces, corner reflectors or some combination thereof depending upon the orientation of the cavities to an incident radar wave.

In accordance with another aspect of the invention, the radar permeable shell serves as an outer covering for a foam interior and reflective cavities. The foam provides buoyancy as well as structural support for the radar reflective cavities. The reflective cavities are constructed of flexible radar reflective materials. The cavities will appear as a group of flat surfaces, tilted surfaces, corner reflectors or some combination thereof depending on the orientation of the cavities to incident radar waves.

In accordance with another aspect of the invention, the radar permeable shell is an inflatable polygonal shape of at least four sides with a plurality of flexible reflectors inside each side in an outward facing direction. The reflectors are situated as an array so that once the raft is inflated they form an array of reflectors. To incident radar waves the side of the raft will appear as groups of flat surfaces, tilted surfaces, corner reflectors or some combination thereof.

In accordance with another aspect of the invention, the radar permeable inflatable shell is a cylindrical. The reflectors are situated as an array so that once the cylinder is inflated they form an array of reflectors.

Still other aspects of the present invention will become apparent to those skilled in the art from the following detailed description of the preferred embodiment. It is possible to modify the invention in obvious respects without departing from the invention. Accordingly, the drawings and description are to be regarded as illustrative in nature, and not as restrictive.

DESCRIPTION OF THE PREFERRED EMBODIMENTS

Figure 1:
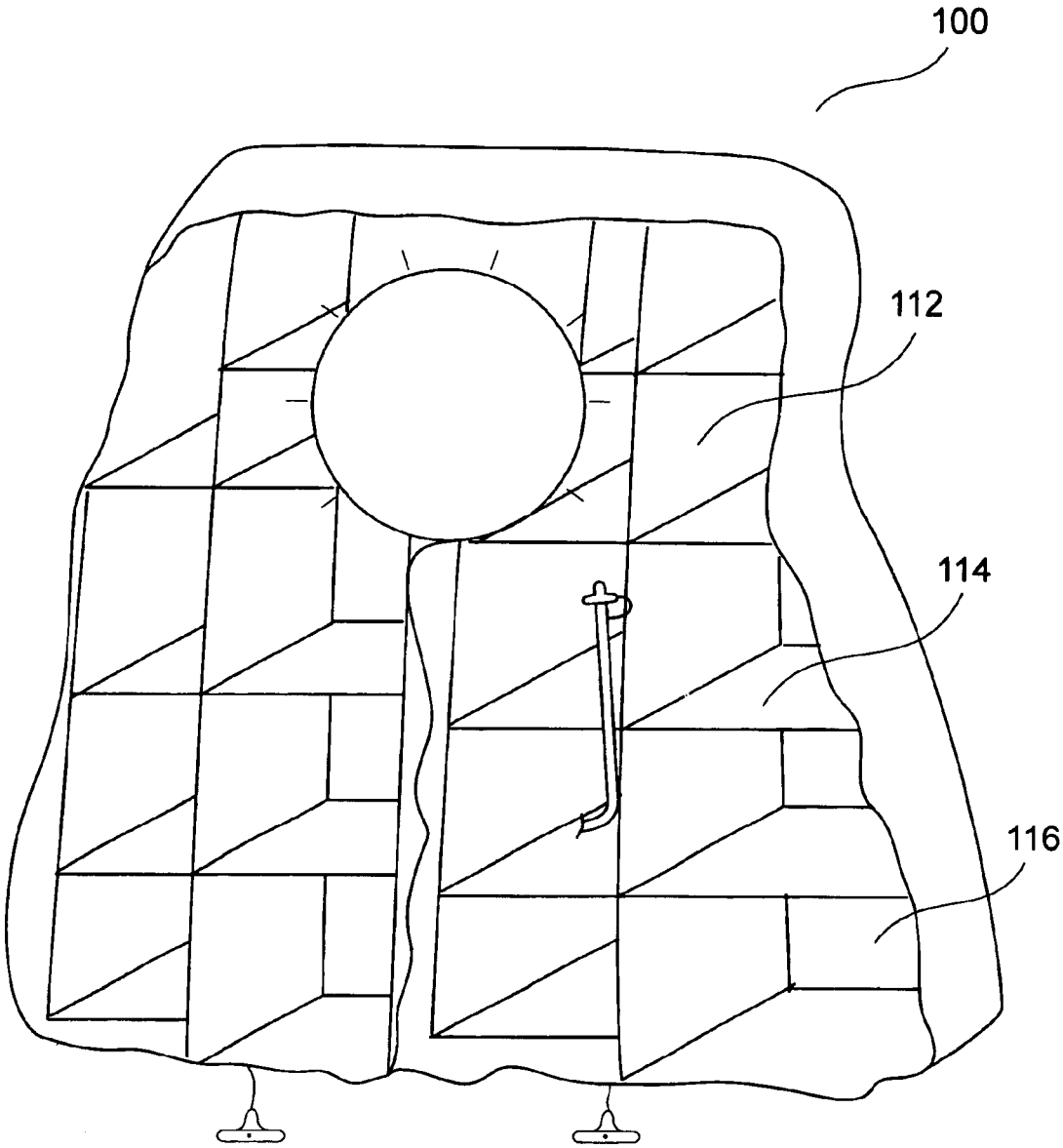
FIG. 1 is perspective view of an inflatable personal flotation device with radar reflector cavities in accordance with the present invention.

Referring more particularly to the drawings, FIG. 1 illustrates an inflatable radar reflective life vest, which represents one embodiment of the invention. The vest 100 is yoke style and is inflated with air. The vest 100 has a series of flexible radar reflective frame members throughout the inside of the vest 100. The shell of the vest 100 may be constructed of any suitable radar permeable covering such as nylon. The frame members are preferably made of metalized Mylar and lay flat when the vest is deflated. It is to be appreciated that any flexible radar reflective material such as aluminum foil, metalized Tedlar or metalized cloth, may be used in place of the metalized Mylar. The frame members are comprised of a large back panel 116 and a plurality of horizontal panels 114 and vertical panels 112. The back panel 116 is attached to the inside of the vest 100 back by suitable means such as adhesive bonding, heat seaming or in any other manner suitable to produce a secure attachment. Heat seaming is the preferred method of attachment in the present invention. The horizontal panels 114 intersect with the vertical panels 112 and both are attached to the back panel 116 at one edge. The other edge of both the horizontal panels 114 and vertical panels 112 are attached at several points to the inside front of the vest so that sufficient structural support is given to the panels but that air may still flow through or around the panels to completely fill the vest. Small perforations of less than an ⅛inch are allowed to enable air flow through the panels. The number of perforations should not exceed ten percent of the panel area so that performance is not adversely affected.

Figure 2:
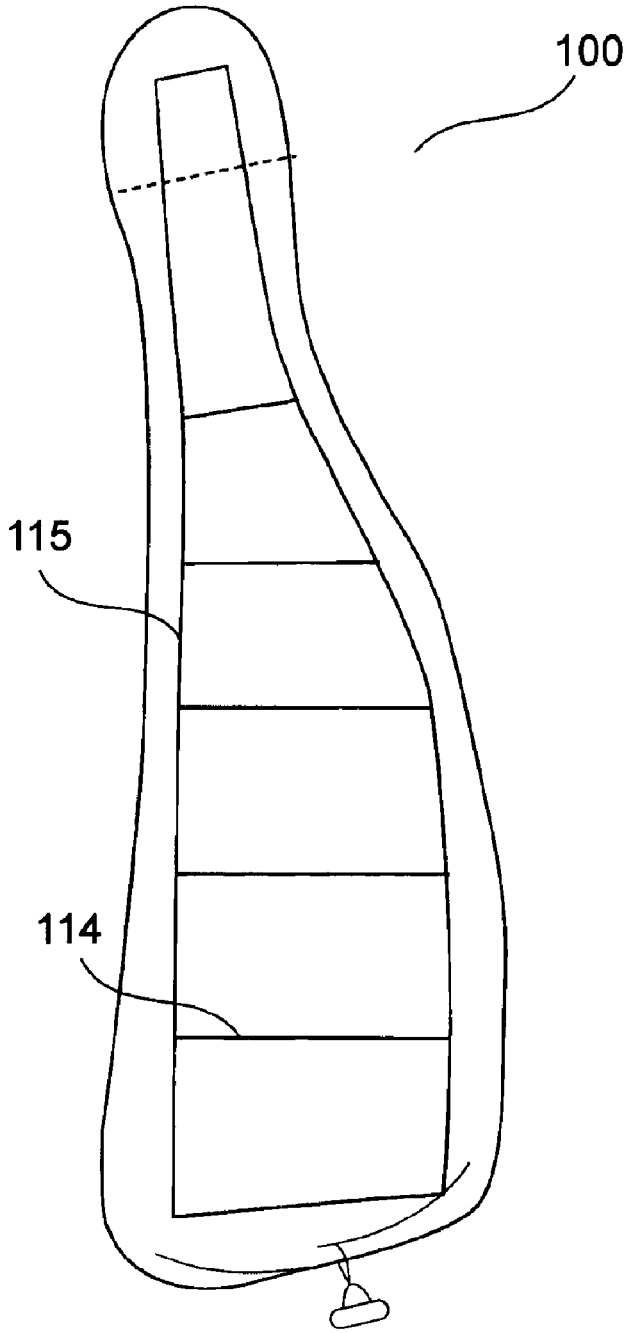
FIG. 2 is a side view of an inflatable personal flotation device with radar reflector cavities in accordance with the present invention.

Upon inflation of the vest, the panels are stretched tight so that the reflective frame members are at right angles to one another. This results in radar reflective cavities being formed throughout the interior of the vest. FIG. 2 shows a side view of an inflated vest 100 and the reflective cavities. These cavities form various reflective surfaces depending on the orientation of the cavity orientation to the incident radar waves. The best results in terms of a large radar cross section are achieved when the majority of reflective cavities are oriented so that the radar waves are reflected by either a flat surface or by corner reflectors. In order for the vest to effectively reflect the radar waves, the front or side of the vest must be facing the source. When the radar waves are incident on the front of the vest the return would be the highest.

Figure 3:
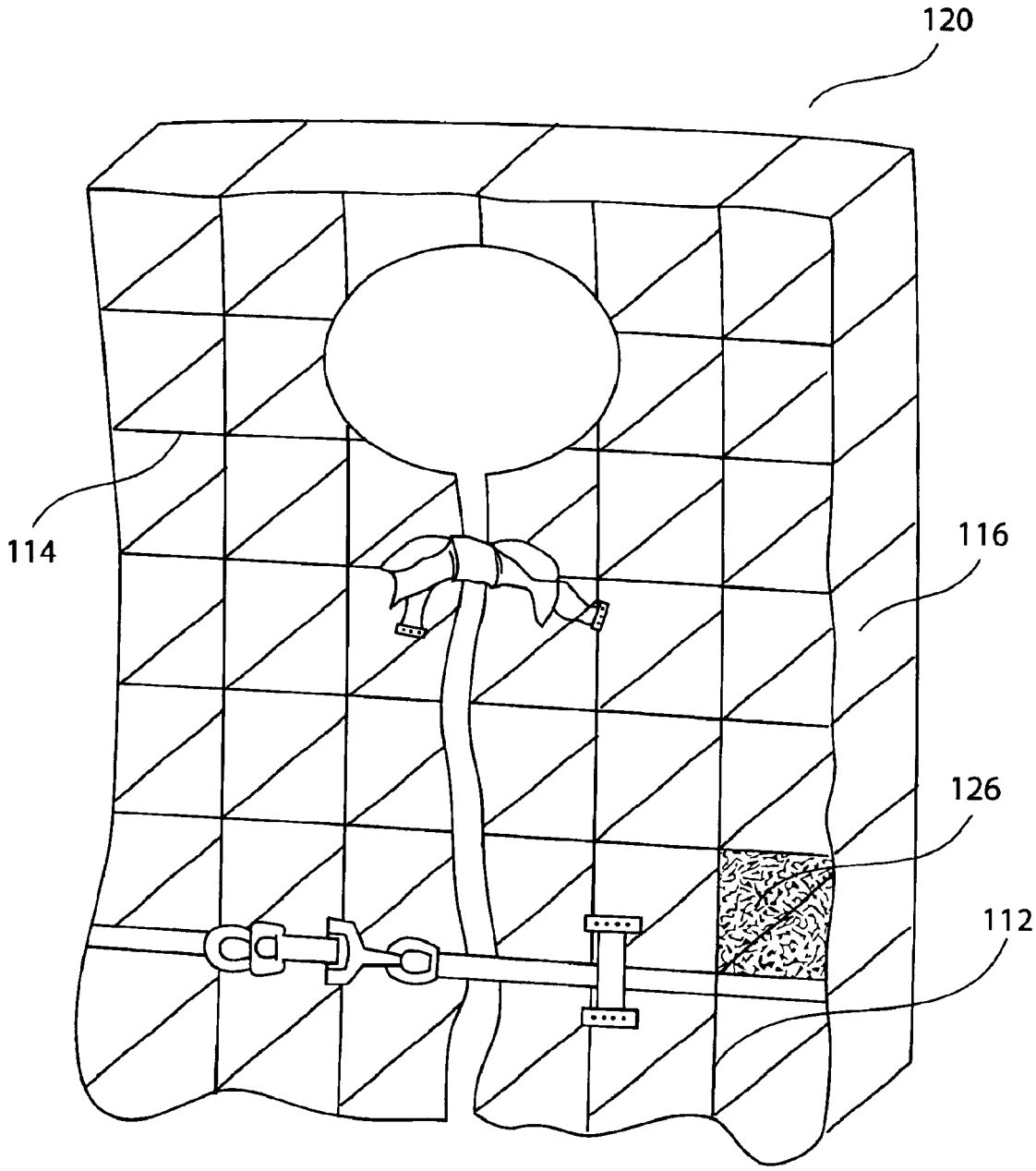
FIG. 3 is a perspective view illustrating a yoke style foam personal flotation device in accordance with the present invention.

FIG. 3 illustrates another embodiment of the present invention in which a radar permeable outer covering contains radar reflective cavities and radar permeable buoyant foam. In this embodiment the flexible reflective frame members are constructed of Mylar in the same fashion as for the inflatable life vest. However, the reflective cavities are provided structural support from buoyant radar permeable foam 126 such as polystyrene or polyurethane foam (the remaining cells are filled similarly). The frame members are held in position at right angles to one another by the foam 126 in order to form the reflective cavities.

Figure 4:
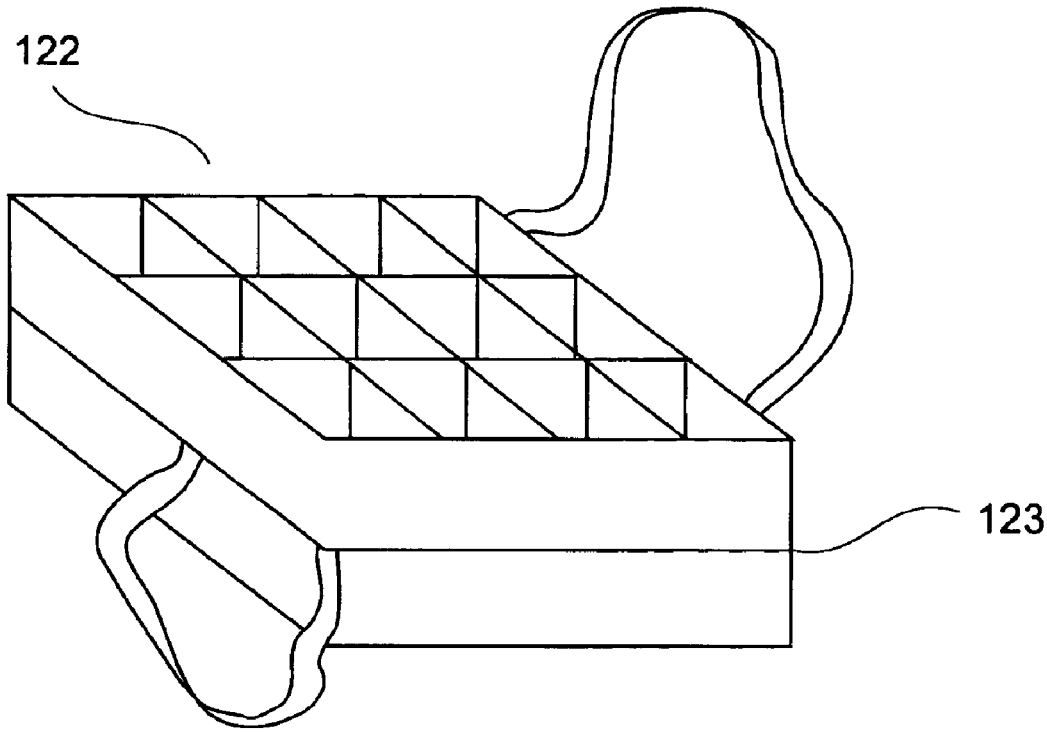
FIG. 4 is a perspective view illustrating a seat cushion foam personal flotation device in accordance with the present invention.

FIG. 4 illustrates that the foam filled embodiment may be readily adapted to other shapes such as a seat cushion 122 intended as a flotation aid, such as those found in a boat or on an airplane. The seat cushion is constructed with a center reflector piece 123 so that it may be oriented either side up and still be effective. The two halves divided on the inside by the center reflector 123 are mirror images of each other and are comprised of a plurality of reflective panels and the common center reflector 123 to form a series of reflective cavities. To provide greater comfort, additional radar permeable foam layers (not shown) can be added on top and bottom of the reflective cavities. In all the cases the panels may be attached to each other and the radar permeable outer shell by suitable means such as adhesive bonding, heat seaming or other manner suitable to produce a secure attachment.

Figure 5A:
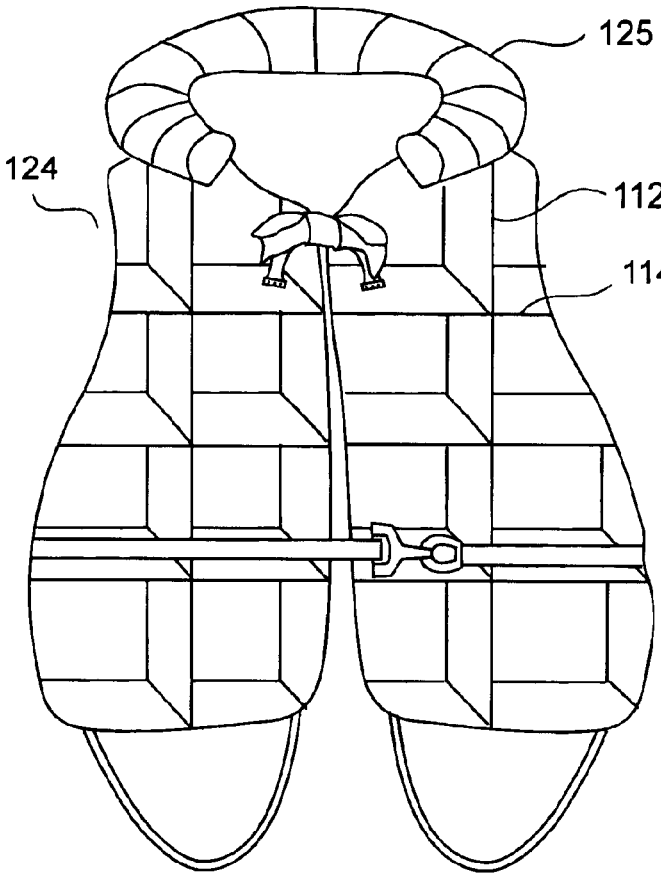
FIG. 5A is a perspective view of kapok style foam filled personal flotation device in accordance with the present invention.
Figure 5B:
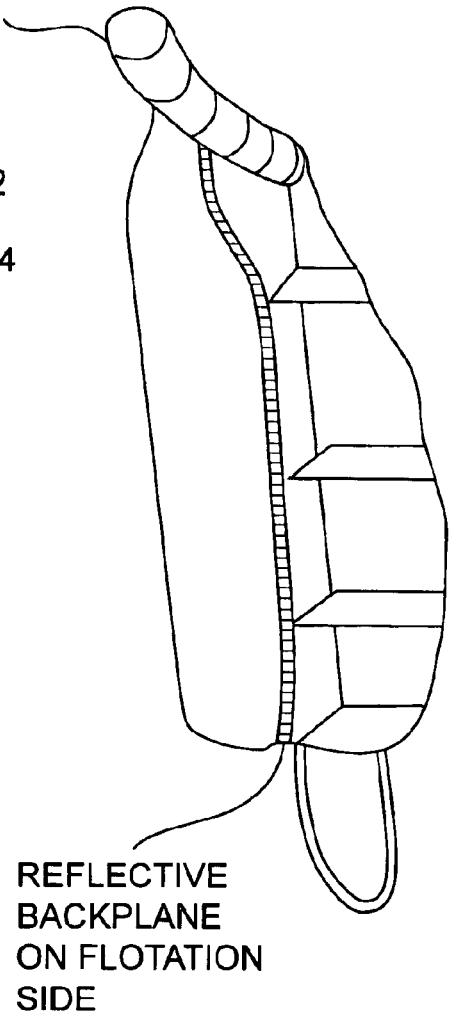
FIG. 5B is a side view of kapok style foam filled personal flotation device in accordance with the present invention.

FIG. 5A is another embodiment of the foam filled version of the present invention. This embodiment is implemented in the Navy kapok style life vest 124 with a radar permeable cover. This vest has a large neck collar 125 to keep the head upright when the person is injured or unconscious. The radar reflective cavities are dispersed throughout the flotation side (i.e. front) of the vest as illustrated in FIG. 5B. The reflective cavities are constructed in a similar fashion to the foam filled vest discussed above. The notable exception is that the reflective back plane 116 would be in front of the wearer at the rear of the main flotation section. Other vest styles such as a jacket or survival suit are also possible using the same radar reflective Mylar cavities. Additionally, it is possible to substitute other flexible radar reflective materials for the Mylar such as heavy-duty aluminum foil or other electrically conductive metallic laminates such as Tedlar or a metalized polyester film.

Figure 6:
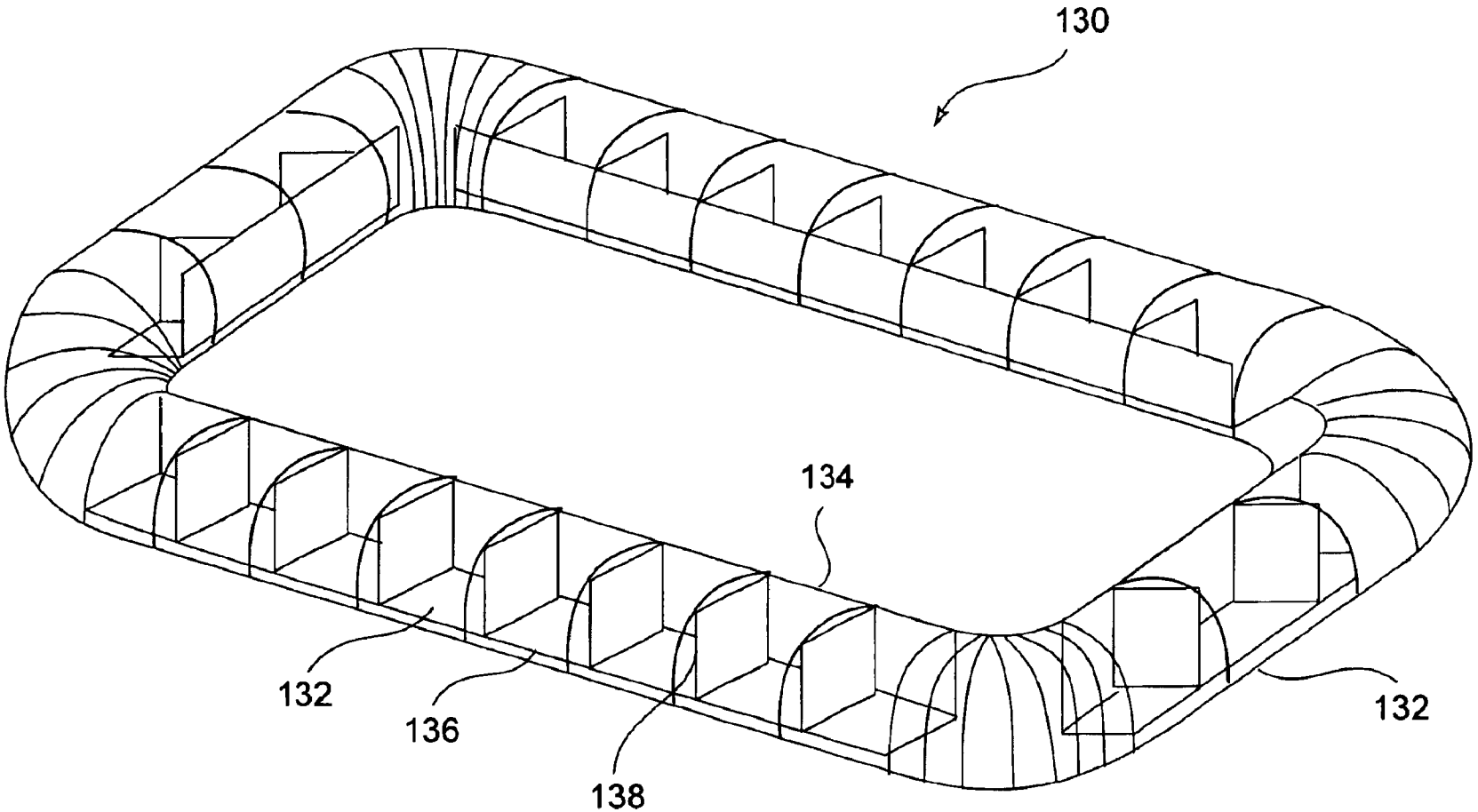
FIG. 6 is a perspective view of an inflatable rectangular life raft with radar reflective cavity arrays in accordance with the present invention.
Figure 7:
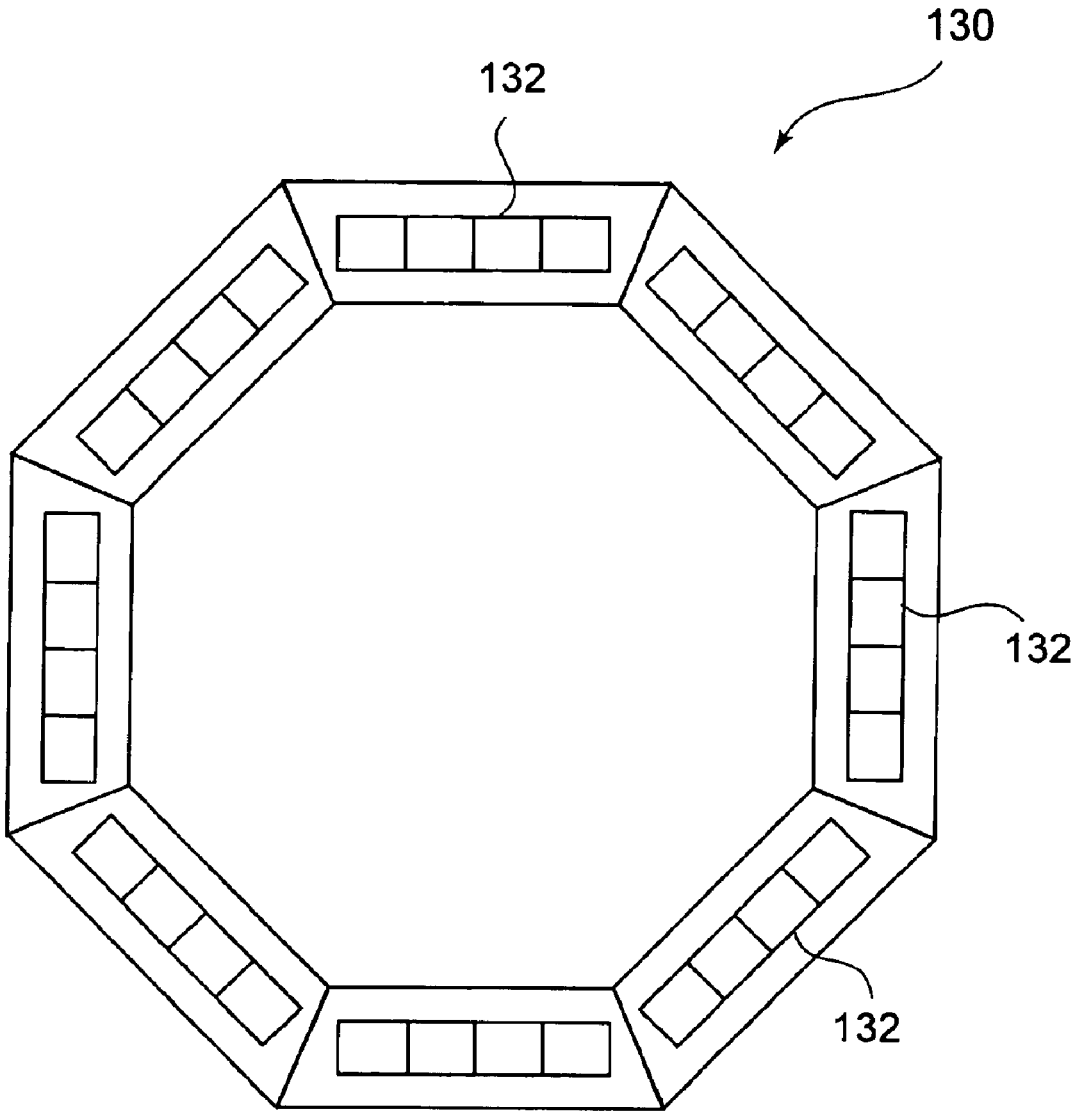
FIG. 7 is a top view of an inflatable octagonal life raft with radar reflective cavity arrays in accordance with the present invention.

Another embodiment of the present invention is illustrated in FIGS. 6 and 7. An inflatable life raft is shown in different configurations. Though only rectangular and octagonal designs are depicted, the same teachings may be applied to any polygonal life raft or a life raft with straight sections. Reflective cavity cells 132 are formed in each straight section of the raft. The raft has on outer airtight covering that is radar permeable. The reflective cavity cells 132 are constructed of flexible Mylar panels, or other suitable radar reflective flexible material, that lay flat when the raft is deflated. The reflective panels are formed with two long flat sections and a plurality of dividing pieces 138. These reflective cavity cells 132 may be adapted to be inserted into any straight section of a small inflatable raft to greatly enhance the rafts radar cross-section.

When the raft is inflated the panels are stretched tight so that all the planar surfaces are at right angles to each other. This is accomplished by attaching the panels to the inside of the raft covering and each other so that the desired result is achieved. Attachment is accomplished by adhesives, bonding, heat seaming or in any other manner suitable to produce a secure attachment. One of the long panels 136 is horizontal in orientation and is secured to the inside of the covering of the raft by heat sealing or other suitable means. The horizontal panel 136 is attached so that it will be above the surface of the water when the raft is floating on the surface of the water. The other long panel 134 has a vertical orientation and is secured along its length to the horizontal panel 136 at one edge. This vertical panel 134 is also secured to the inside of the raft covering by suitable means. Disposed within the trough formed by the horizontal panels 136 and the vertical in panels 134 are a plurality of dividers 138. These dividers 138 are attached to both the horizontal panels 136 and the vertical panels 134 so that upon inflation of the raft the dividers are parallel to each other and are at right angles to both the horizontal panels 136 and the vertical panels 134. The stretched panels form reflective cells 132 comprised of a series of outwardly facing corner reflectors. It is also possible to assemble a series of boxes consisting of radar transparent panels (not shown) added to the front and top edges of the radar reflective cavity arrays for added structural support with the radar reflective panel sections comprising a series of corner reflectors. These corner reflectors could be fabricated separately and then inserted into the air chambers of a life raft and attached so that upon inflation the desired corner reflectors are formed.

Figure 8:
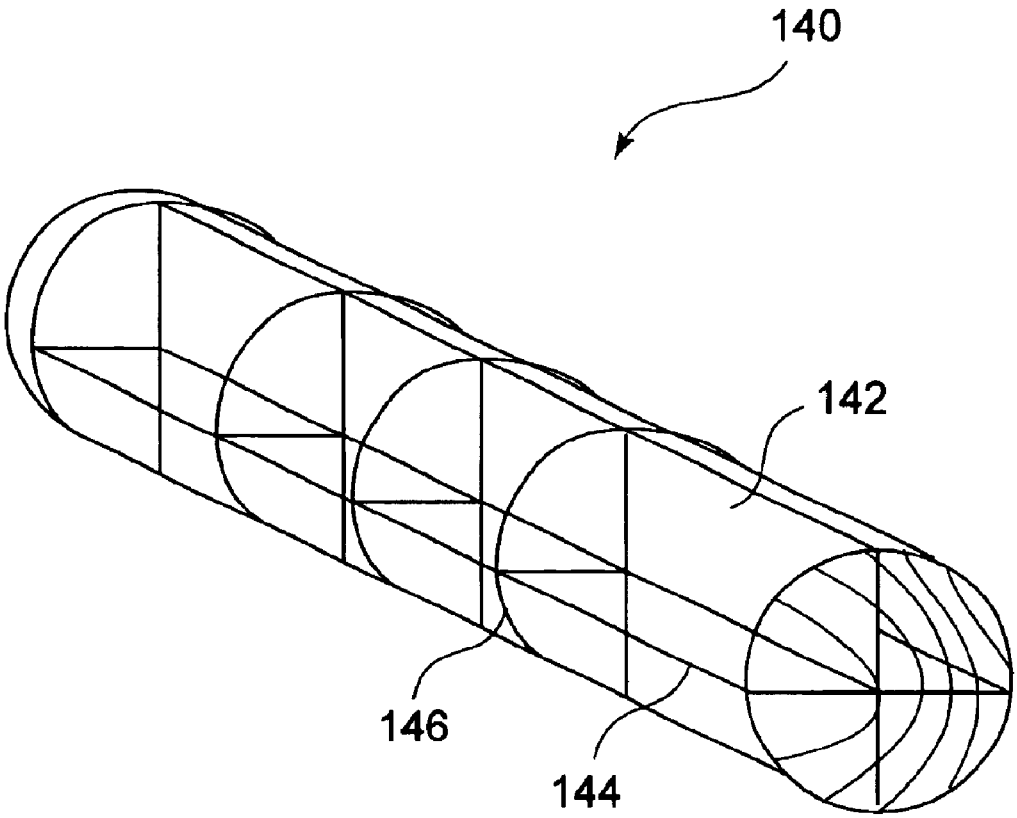
FIG. 8 is a perspective view of cylindrical radar cross-section enhancer.

FIG. 8 represents an inflatable cylindrical tube 140 that can be attached to an object to provide enhanced radar cross-section. The tube 140 may be attached to a person or to a life raft to increase the chances of radar return. This cylindrical tube 140 has an outer airtight covering that is radar permeable and a series of reflective cavity cells constructed of flexible Mylar panels, or other suitable radar reflective flexible material, that lay flat when the cylinder is deflated. The panels are attached in such a fashion so that upon inflation a series of corner reflectors are formed throughout the tube. Dividing the cylinder 140 longitudinally in quarters with a first reflective panel 142 and a second reflective panel 144 that intersect orthogonally. The reflective cavities are constructed by further dividing the intersecting panels with a plurality of orthogonal dividing panels 146. The panels are attached at several points to the inside of the tube so that sufficient structural support is given to the panels but that air may still flow through or around the panels to completely fill the tube. Attachment is achieved through suitable means such as adhesive bonding, heat seaming or in any other manner suitable to produce a secure attachment. Small perforations of less than an ⅛ inch are allowed to enable air flow through the panels. The number of perforations should not exceed ten percent of the panel area so that performance is not adversely affected. Heat seaming or other suitable means may be used to join the panels to each other and the outer covering.

What has been described is only a few of many possible variations on the same invention and is not intended in a limiting sense. The claimed invention can be practiced using other variations not specifically described above.

What is claimed is:

1. A radar reflective device comprising:

a radar permeable shell;

a plurality of flexible radar reflective panel is disposed within said shell so as to form reflective cavities;

means for attaching said flexible radar reflector panels to inside of said shell; and radar permeable foam disposed in each of said reflective cavities whereby said reflective cavities are given form and support from said foam.

2. A radar reflective device as in claim 1 wherein said device is a personal flotation device.

3. A radar reflective device as in claim 2 wherein said personal flotation device is a life vest.

4. A radar reflective device as in claim 2 wherein said personal flotation device is a seat cushion.

5. A radar reflective personal flotation device comprising:

a radar permeable shell;

a planar radar reflective panel dividing the interior of said shell into two sections;

a plurality of reflective panels intersecting said planar radar reflective panel, wherein said intersecting panels form a plurality of reflective cavities in each said section of said shell; and a plurality of radar permeable foam disposed within each said reflective cavity.

6. A radar reflective device comprising:

a radar permeable outer shell;

panel means for internally dividing the shell into a plurality of radar reflective cavities; and means for internally shaping said cavities by inflation, and wherein said inflation of the cavities is effected by inflow of radar permeable foam.

7. A radar reflective device comprising:

a radar permeable inflatable shell;

a plurality of flexible radar reflective panels disposed within said shell so as to form a plurality of reflective cavities upon inflation; and means for attaching said flexible radar reflective panels to said shell so as to arrange said flexible radar reflective panels into a plurality of reflective cavities upon inflation of said shell, and wherein said shell is cylindrical, and wherein said device is a personal flotation or a life vest.

8. A radar reflective device as in claim 7, wherein said personal flotation device is a life raft.

* * * * *